US008991441B2

(12) United States Patent
Gill

(10) Patent No.: US 8,991,441 B2
(45) Date of Patent: Mar. 31, 2015

(54) HOT-FILLABLE CONTAINER WITH MOVEABLE PANEL AND SYSTEMS AND METHODS THEREOF

(75) Inventor: Matthew T. Gill, Hellam, PA (US)

(73) Assignee: Graham Packaging Company, L.P., York, PA (US)

( * ) Notice: Subject to any disclaimer, the term of this patent is extended or adjusted under 35 U.S.C. 154(b) by 50 days.

(21) Appl. No.: 13/410,902

(22) Filed: Mar. 2, 2012

(65) Prior Publication Data

US 2013/0228249 A1 Sep. 5, 2013

(51) Int. Cl.

| | |
|---|---|
| ***B65B 1/04*** | (2006.01) |
| ***B65B 3/04*** | (2006.01) |
| ***B65D 1/02*** | (2006.01) |
| ***B65D 79/00*** | (2006.01) |

(52) U.S. Cl.

CPC ..... *B65D 1/0223* (2013.01); *B65B 3/04* (2013.01); *B65B 2220/24* (2013.01); *B65D 1/0276* (2013.01); *B65D 79/005* (2013.01); *B65D 2501/0081* (2013.01)

USPC ..... 141/2; 215/383; 220/666; 220/669

(58) Field of Classification Search

USPC ..... 141/2; 215/381, 382, 383, 384; 220/600, 660, 666, 669

See application file for complete search history.

(56) References Cited

U.S. PATENT DOCUMENTS

| | | | | |
|---|---|---|---|---|
| 4,749,092 | A | 6/1988 | Sugiura et al. | |
| 5,141,121 | A | 8/1992 | Brown et al. | |
| 5,178,290 | A * | 1/1993 | Ota et al. | 215/382 |
| 5,199,587 | A | 4/1993 | Ota et al. | |
| 5,199,588 | A * | 4/1993 | Hayashi | 215/381 |
| 5,279,433 | A * | 1/1994 | Krishnakumar et al. | 215/381 |
| 5,472,105 | A * | 12/1995 | Krishnakumar et al. | 215/384 |
| 5,704,504 | A * | 1/1998 | Bueno | 215/381 |
| 5,762,221 | A | 6/1998 | Tobias et al. | |
| D450,595 | S | 11/2001 | Ogg et al. | |
| D482,976 | S | 12/2003 | Melrose | |
| D492,201 | S | 6/2004 | Pritchett et al. | |
| 6,763,969 | B1 * | 7/2004 | Melrose et al. | 220/669 |
| 6,779,673 | B2 | 8/2004 | Melrose et al. | |
| 6,796,450 | B2 | 9/2004 | Prevot et al. | |
| 6,929,138 | B2 | 8/2005 | Melrose et al. | |
| 6,974,047 | B2 | 12/2005 | Kelley et al. | |
| D531,910 | S | 11/2006 | Melrose | |
| 7,137,520 | B1 | 11/2006 | Melrose | |
| D535,884 | S | 1/2007 | Davis et al. | |
| D538,168 | S | 3/2007 | Davis et al. | |
| D547,664 | S | 7/2007 | Davis et al. | |
| D572,599 | S | 7/2008 | Melrose | |
| D576,041 | S | 9/2008 | Melrose et al. | |
| 7,694,842 | B2 | 4/2010 | Melrose | |
| D623,952 | S | 9/2010 | Yourist et al. | |
| 7,882,971 | B2 * | 2/2011 | Kelley et al. | 215/373 |
| D637,495 | S | 5/2011 | Gill et al. | |
| D646,966 | S | 10/2011 | Gill et al. | |
| D653,119 | S * | 1/2012 | Hunter et al. | D9/560 |
| D653,550 | S | 2/2012 | Hunter | |

(Continued)

*Primary Examiner* — Jason K Niesz
(74) *Attorney, Agent, or Firm* — Baker Botts L.L.P.

(57) ABSTRACT

A plastic, hot-fillable container which has one or more moveable portions each comprised of intersecting perpendicular recesses. Each of the one or more moveable portions is constructed to move outwardly temporarily without permanently deforming responsive to hot-filling the container with a product. The one or more moveable portions also can be constructed to move inwardly to reduce a portion of an internal vacuum within the filled and capped container.

16 Claims, 9 Drawing Sheets

(56) References Cited

U.S. PATENT DOCUMENTS

| | | | | |
|---|---|---|---|---|
| D653,957 | S | 2/2012 | Yourist et al. | |
| 2002/0158038 | A1 | 10/2002 | Heisel et al. | |
| 2003/0015491 | A1 | 1/2003 | Melrose et al. | |
| 2003/0205550 | A1 | 11/2003 | Prevot et al. | |
| 2004/0016716 | A1 | 1/2004 | Melrose et al. | |
| 2004/0129669 | A1 | 7/2004 | Kelley et al. | |
| 2005/0218108 | A1* | 10/2005 | Bangi et al. | 215/384 |
| 2006/0151425 | A1 | 7/2006 | Kelley et al. | |
| 2007/0017892 | A1* | 1/2007 | Melrose | 215/381 |
| 2007/0045222 | A1* | 3/2007 | Denner et al. | 215/382 |
| 2007/0131644 | A1 | 6/2007 | Melrose | |
| 2008/0257856 | A1* | 10/2008 | Melrose et al. | 215/381 |
| 2010/0116778 | A1* | 5/2010 | Melrose | 215/381 |
| 2010/0213204 | A1 | 8/2010 | Melrose | |
| 2011/0049084 | A1 | 3/2011 | Yourist et al. | |
| 2011/0084046 | A1 | 4/2011 | Schlies et al. | |
| 2011/0094618 | A1 | 4/2011 | Melrose | |
| 2011/0108515 | A1 | 5/2011 | Gill et al. | |
| 2011/0132865 | A1 | 6/2011 | Hunter et al. | |
| 2011/0284493 | A1 | 11/2011 | Yourist et al. | |

* cited by examiner (OUTWARD FLEXING)
CROSS SECTION A-A′

(INWARD FLEXING)
CROSS SECTION A-A′

HOT-FILLABLE CONTAINER WITH MOVEABLE PANEL AND SYSTEMS AND METHODS THEREOF

SUMMARY

The present invention generally relates to plastic containers with one or more moveable portions or panels. More specifically, embodiments of the present invention involve hot-fillable plastic containers and systems and methods thereof that can accommodate internal pressures within the containers by controlled movement of one or more moveable panels or portions without unwanted permanent deformations or distortion of the one or more moveable panels or portions or other areas of the containers.

An embodiment or embodiments of the present invention include a plastic container comprising: an upper portion defining an opening into an internal volume of the container; a body portion having a sidewall with a predefined moveable portion, said predefined moveable portion including a first recess running in a first direction and a second recess running in a second direction perpendicular to the first direction, the second recess physically bisecting the first recess so as to divide the first recess into a first recess portion of the first recess and a second recess portion of the first recess; and a base portion for supporting the plastic container in an upright position.

Optionally, the predefined moveable portion can further include at least one additional recess running in the first direction and being physically bisected by the second recess so as to divide the at least one additional recess into first and second portions thereof, wherein the second recess is deeper than the first recess, and wherein the second recess is deeper than the at least one additional recess. Optionally, the predefined moveable portion can further comprise a third recess running in the second direction and a fourth recess running in the second direction, the third recess physically crossing the first recess portion of the first recess, and the fourth recess physically crossing the second recess portion of the first recess. The third recess running in the second direction may physically cross the first recess so as to split the first recess into the first recess portion and a third recess portion, wherein the third recess portion can be at one extremity of the first recess, and the fourth recess running in the second direction may physically cross the first recess so as to split the first recess into the second recess portion and a fourth recess portion, wherein the fourth recess portion can be at another extremity of the first recess opposite to the one extremity of the first recess. Optionally, the third and fourth recesses have the same dimensions, the second recess has a maximum width greater than a maximum width of the third and fourth recesses, the first and second recess portions have the same dimensions, and/or the third and fourth recess portions have the same dimensions.

The plastic container may have a plurality of predefined moveable portions including the predefined moveable portion in the sidewall and one or more additional predefined moveable portions in either the sidewall or elsewhere. Further, optionally, the sidewall defines a plane, wherein the predefined moveable portion is entirely recessed with respect to the plane of the sidewall and surrounded by a continuous downward transition from the sidewall. Additionally, optionally, the predefined moveable portion can be configured and operative to move from a first, as-formed position outwardly to a second position, and to move inwardly to a second position after movement thereof to the second position.

The present invention also includes an embodiment or embodiments directed to a method involving a plastic container having a recessed moveable portion including or being made up of crisscrossing grooves, a length-wise direction of a first groove being perpendicular to a length-wise direction of a second groove, and a width-wise direction of the first groove being parallel to the length-wise direction of the second groove, the second groove being deeper than the first groove, the method comprising: providing the plastic container with the recessed moveable portion; and moving outward the recessed moveable portion in response to a predetermined internal force from within the plastic container caused by filling the container with a product at an elevated temperature, the movement outward of the recessed moveable portion being such that the recessed moveable portion breaks a surface plane of a non-recessed portion of a corresponding sidewall of the plastic container surrounding the moveable portion, and such that the recessed moveable portion does not undergo unwanted deformation or distortion. Optionally, the method can further comprise moving inward the recessed moveable portion in response to a vacuum within the plastic container caused by cooling of the product filled into the plastic container, the moving inward reducing some of the vacuum, all of the vacuum, or all of the vacuum plus creating a positive pressure within the plastic container. The unwanted deformation or distortion of the recessed moveable portion may be a permanent deformation or distortion not capable of being satisfactorily rectified by a force or forces associated with a predetermined vacuum created in the plastic container.

An embodiment or embodiments of the present invention also include a hot-fillable plastic bottle of generally square shape in bottom end view, but with chamfered corners, the plastic bottle being without any hoop rings and comprising: a threaded upper portion defining an opening into the bottle and having a lip at an end thereof opposite the opening, the threaded upper portion being configured to be threadedly mated with a cap to create an air-tight seal; an elongate neck portion arranged adjacent to the threaded upper portion, the elongate neck portion gradually tapering radially outward in a direction moving away from the threaded upper portion; a body portion having four sidewalls and being arranged adjacent to a widest part of the elongate neck portion, each of the sidewalls having a recessed moveable panel with a generally rectangular perimeter in a side view of the bottle, long sides of the moveable panel running in a longitudinal direction of the bottle, and the recessed moveable panel including: a vertically oriented groove centrally aligned within the perimeter of the moveable panel and having a maximum depth thereof at a first depth, and three horizontally oriented grooves each having maximum depths thereof at a second depth greater than the first depth, each of the three horizontally oriented grooves interrupting the vertically oriented groove, and the vertically extending groove having a portion arranged above a top one of the horizontally oriented grooves in the longitudinal direction of the bottle and a portion arranged below a bottom one of the horizontally oriented grooves in the longitudinal direction of the bottle; and a base portion arranged adjacent to the body portion and having a lower-most portion thereof defining a standing surface of the bottle and a push-up bottom end portion arranged axially inward of the standing surface of the base portion. Each of the moveable panels can be configured and operative (i) to flex outward temporarily without permanently deforming, rolling-out, or inverting in response to an internal pressure within the bottle based on hot-filling and sealing the bottle, and (ii) to flex inward in response to an internal vacuum caused by cooling of the hot-filled and sealed bottle to thereby take up a portion of the internal vacuum.

Optionally, each of the recessed moveable panels is configured and operative flex outward temporarily to break a surface plane of a corresponding one of the four sidewalls without permanently deforming, rolling-out, or inverting in response to the internal pressure. Further, the flexing inward of each of the moveable panels can be to a respective position radially inward of an as-formed position of the moveable panel. The flexing inward of the moveable panels optionally may be by a same amount or substantially a same amount for each of the moveable panels. Further, the flexing outward of the moveable panels may be by a same amount or substantially a same amount for each of the moveable panels.

The portion of the internal vacuum taken up by the flexing inward of the moveable panels may be the entire internal vacuum. Optionally, the flexing inward of the moveable panels takes up the entire internal vacuum and creates a positive pressure within the bottle.

In one or more embodiments, the push-up bottom end portion of the base portion does not move in response to internal pressures caused by hot-filling, sealing, and/or cooling the bottle. Alternatively, the portion of the internal vacuum taken up by the flexing inward of the moveable panels is not the entire internal vacuum, and the push-up bottom end portion is caused to move toward the interior of the bottle to remove the remainder of the internal vacuum. Further, optionally, movement toward the interior of the bottle of the push-up bottom end portion creates a positive pressure within the bottle. The push-up bottom end portion is configured and operative to be always at or above the standing surface of the bottom portion of the bottle.

An embodiment or embodiments of the present invention also include systems and/or apparatuses that perform any of the methods or portions thereof shown and described herein or variants or equivalents thereof. Furthermore, an embodiment or embodiments of the present invention additionally include systems and/or apparatuses that handle or process containers as shown and described herein or variants or equivalents thereof.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Any values dimensions illustrated in the accompanying graphs and figures are for illustration purposes only and may or may not represent actual or preferred values or dimensions. Where applicable, some features may not be illustrated to assist in the description of underlying features.

DESCRIPTION

Figure 1A:
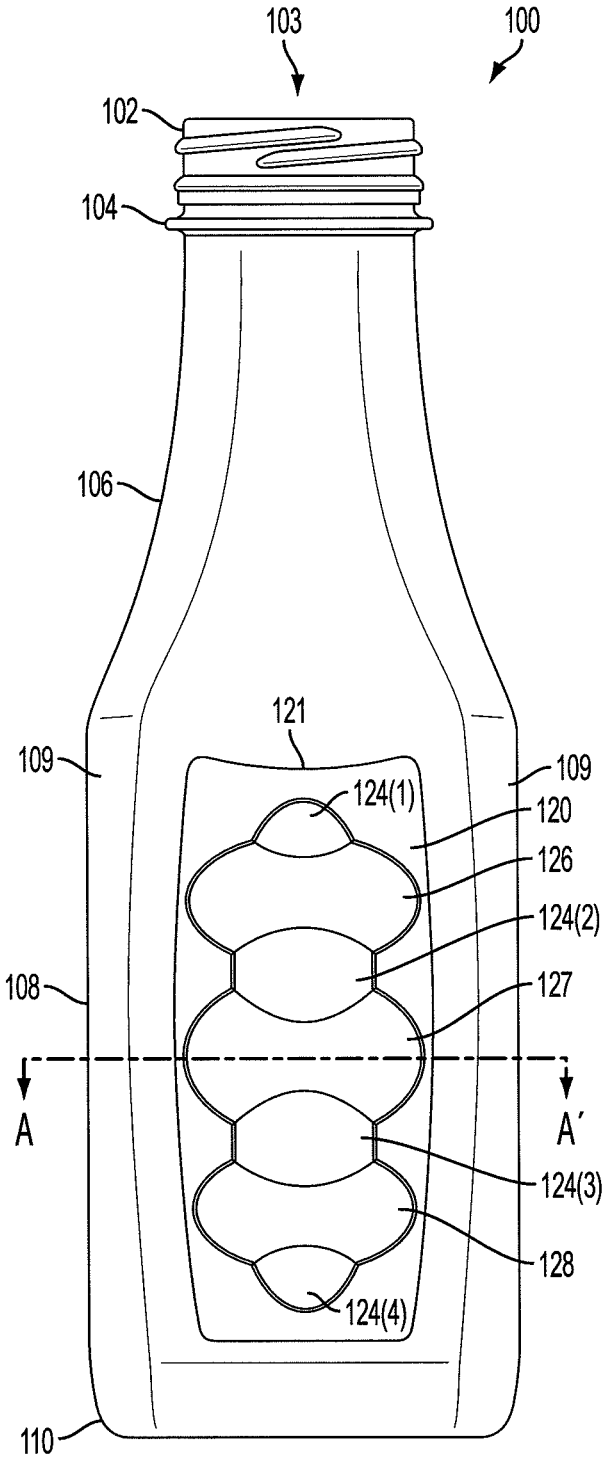
FIG. 1A is a side view of a container according to an embodiment or embodiments of the present invention.

The description set forth below in connection with the appended drawings is intended as a description of various embodiments of the disclosed subject matter and is not intended to represent the only embodiments in which the disclosed subject matter may be practiced. The description includes specific details for the purpose of providing a thorough understanding of the disclosed subject matter. However, it will be apparent to those skilled in the art that the disclosed subject matter may be practiced without these specific details. In some instances, well-known structures and components may be shown in block diagram form in order to avoid obscuring the concepts of the disclosed subject matter.

In general, the present invention relates to plastic containers with one or more moveable panels or portions and systems, methods, and apparatuses thereof. In particular, embodiments of the present invention involve plastic containers and systems and methods thereof that can accommodate internal pressures (e.g., positive and/or negative) within the containers by controlled movement or flexing of one or more moveable panels or portions and without unwanted or undesirable deformations of the one or more moveable panels or portions or other areas of the containers. The unwanted or undesirable deformations or distortions can be a bulge in a sidewall of the container, for instance, at an outward pivot point of one or more of the moveable panels or portions in the sidewall. Such unwanted or undesirable deformation may be in the form of roll-out (e.g., a hinged roll-out), pop-out, or inversion caused by internal forces within the container due to hot-filling and/or capping the container, including forces on various parts of the container, such as at the base and sidewall(s), due to the weight of the product and increased pressure caused by expansion. Further, such unwanted or undesirable deformation or distortion of the container may be an irreversible or permanent deformation or distortion, for instance, not capable of being rectified or satisfactorily rectified by a force or forces associated with a predetermined vacuum created in the plastic container.

Thus, embodiments of the present invention can be resistant to the aforementioned unwanted or undesirable distortions or deformations. One or more moveable portions, for instance, moveable panels, may flex or move outward in response to internal pressures within a container without causing impermissible or unwanted bulging, popping out, or inverting. In certain cases, embodiments may be deemed bulge-resistant. Resistance to or otherwise compensating or counteracting for unwanted or undesirable distortions or deformations can be addressed by a configuration of each of the one or more moveable portions. For instance, the configuration of a moveable portion can remove or substantially remove a pivot point for outward movement of the moveable portion, thereby preventing a situation where the moveable portion would be caused to move past a predetermined failure point whereby the moveable portion would become irreversibly or permanently deformed or distorted.

Furthermore, moveable portions according to embodiments of the present invention can, in addition to resisting unwanted or undesirable distortions or deformations, also remove or reduce a portion of a vacuum within the filled and sealed container. Accordingly, moveable portions according to embodiments of the present invention can provide structure to resist or prevent unwanted or undesirable movement thereof and/or of other container portions, while also being flexible to achieve a required amount of vacuum uptake.

Figure 1B:
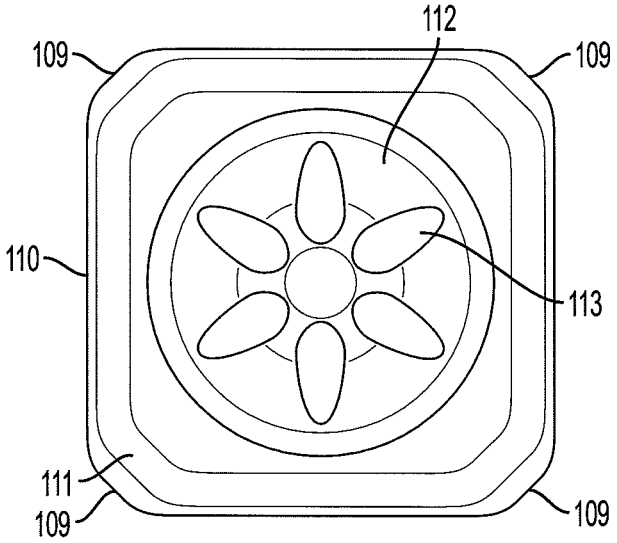
FIG. 1B is a bottom end view of the container of FIG. 1A.
Figure 1C:
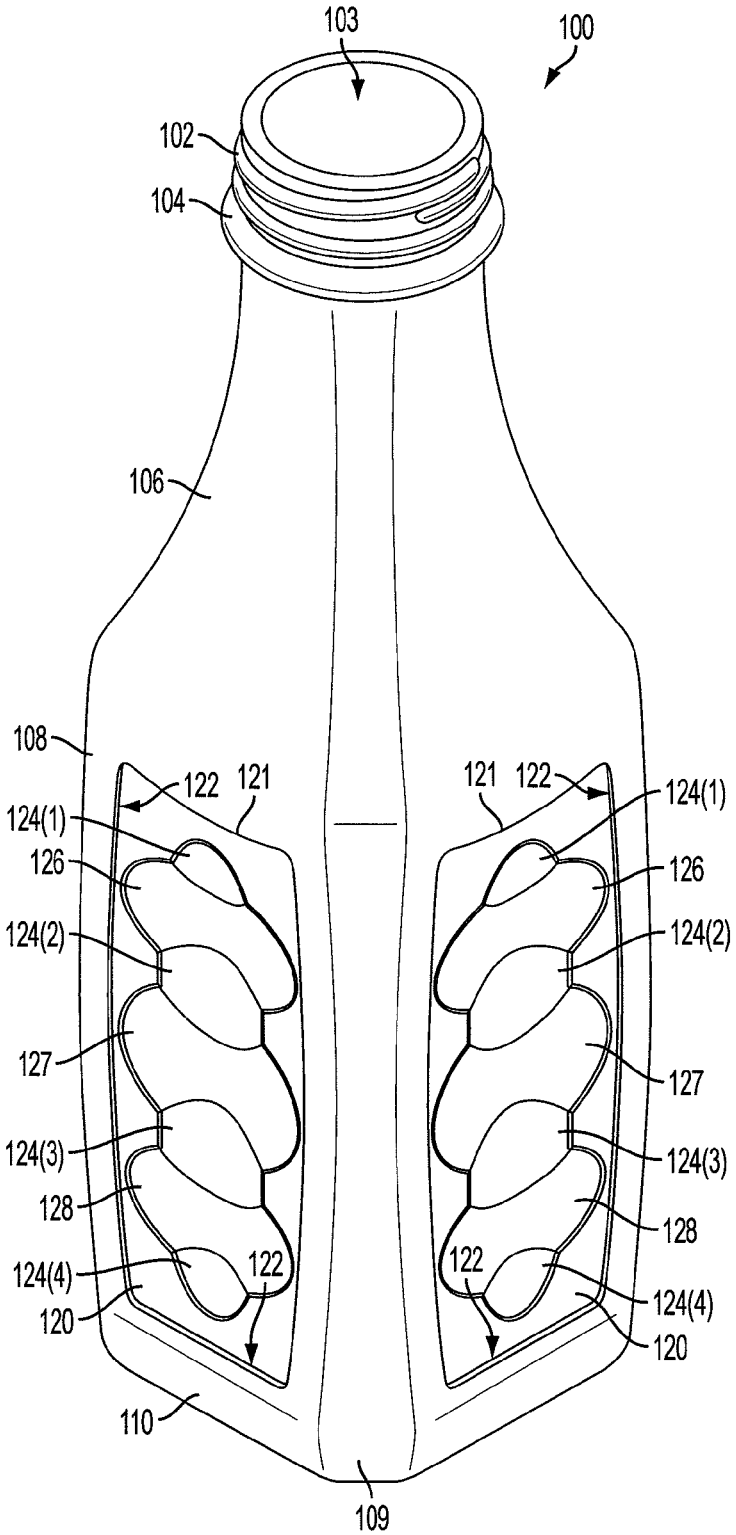
FIG. 1C is a perspective view of the container of FIG. 1A.

FIGS. 1A-1C show a container 100 in the form of a bottle with moveable portions 120. Of course embodiments of the present invention are not limited to containers in the form of bottles and may include jars, jugs, cans, tubes, etc., of symmetrical and asymmetrical geometries. Containers according to embodiments of the present invention can be hot-fillable, that is, designed, constructed, and configured to be filled with a product at an elevated temperature. The fill temperature of the product can be in the range of at or about 180 degrees Fahrenheit to at or about 200 degrees Fahrenheit, for instance at or about 185 degrees Fahrenheit. Optionally, the range may be expanded, for instance to include fill temperatures above and/or below the aforementioned range, such as at or about 205 degrees Fahrenheit. Further, optionally, containers according to embodiments of the present invention can be designed, constructed, and configured to be subjected to pasteurization processes, whereby the contents of the container may be heated to 205 degrees or above, for instance 212 degrees Fahrenheit. Containers according to embodiments of the present invention may be filled with a variety of products, including tea, carbonated beverages, water, sport drinks, or applesauce, for example.

Container 100 can have an upper portion 102 defining an opening 103 into the container and having a lip 104 at an end thereof opposite the opening. Optionally, the upper portion 102 may be threaded and configured to be sealingly mated or coupled to a closure, such as a cap or a lid, to create an air- and liquid-tight seal. Alternatively, the upper portion 102 may not be threaded, and may have an alternative mechanism for sealing the bottle, such as a chemically adhered metal foil closure.

Container 100 may also have a neck portion 106 arranged adjacent to the upper portion 102. Optionally or alternatively, the container 100 may have a shoulder portion. Neck portion 106 may be a neck portion, which may be an elongate neck portion that gradually tapers radially outward in a direction moving away from the upper portion 102. Though shown as concave taper, alternatively the neck portion 106 my taper in a convex manner from the upper portion 102. Further, neck portion 106 may round about its circumference at a top portion thereof and gradually transition to the shape of the container body, in this instance, generally square, as will be discussed in more detail below. Not expressly shown in FIGS. 1A-1C, neck portion 106 may optionally include surface features, such as one or more vacuum panels, one or more ribs, one or more braces, one or more designs, etc.

Container 100 also has a body portion 108 arranged adjacent to the neck portion 106. The body portion 108 can have a plurality of sidewalls. In the case of container 100, the body portion 108 is generally in the form of a rectangular prism (without top and bottom sides) and with a horizontal cross section that is generally square. As such, the body portion 108 has four sidewalls. Optionally, each sidewall may be separated by a chamfered corner portion 109, thus the generally square nomenclature. The cross-section of the body portion 108 may also be termed generally square because the sidewalls may have a slight bow, arc, or curvature and/or because the corner portions may be rounded rather than chamfered. Alternatively, the body portion 108 may have a square or substantially square horizontal cross-section.

Of course embodiments of the present invention are not limited to the foregoing geometries and any suitable geometries may be employed, such as a rectangular or generally rectangular horizontal cross-section, an oval or generally oval horizontal cross-section. For instance, in the case of a container with rectangular or generally rectangular horizontal cross-section, one moveable portion may be implemented at each of the short sidewalls and one or more moveable portions may be implemented at each of the long sidewalls. Alternatively, the moveable portion or features thereof may be larger or duplicated for each of the long sidewalls as compared to the moveable portion or features thereof at each of the short sidewalls. Further, optionally, numerous (e.g., six) "flat" sidewalls may be implemented so as to make the container body portion close to circular in cross-section. Additionally, in embodiments, a circular sidewall in cross-section may be implemented, so long as the curvature of the sidewall is sufficiently "flat" to incorporate therein one or more moveable portions according to embodiments of the present invention. In some embodiments, an asymmetrical container body may be implemented, whereby one or more flat or relatively flat sidewalls are implemented and have one or more moveable portions according to embodiments of the prevent invention and another portion of the container body has a grip portion, such as a deep-set grip.

Furthermore, some embodiments of the present invention, such as container 100 shown in FIGS. 1A-1C, do not have any hoop rings, bumpers, or annular support structure at the juncture of the neck portion 106 and body portion 108. However, one or more embodiments of the present invention may include a hoop ring, a bumper, or an annular structure at this juncture.

Each sidewall may have one or more moveable portions 120. Container 100 shown in FIGS. 1A-1C, for instance, has one moveable portion 120 per sidewall. However, alternatively, container 100 may be configured differently from a moveable portion 120 standpoint. For example, only one moveable portion 120 may be employed per container (i.e., on one sidewall), or only two moveable portions 120 may be employed per container, one each on respective opposite sidewalls. Furthermore, in alternative embodiments, more than one moveable portion 120 may be implemented per sidewall, of course scaling or modifying dimensions of aspects of the portions and/or sidewalls appropriately where necessary.

Moveable portions 120 shown in FIGS. 1A-1C are in the form of moveable panels, defined by a perimeter 121. The moveable panel 120 may be recessed with respect to a plane of the corresponding sidewall. Perimeter 121 may define the beginning of the recess and may include a step or downward transition 122 from the sidewall to the moveable panel 120. Moveable panel 120 may be in the form, generally, of a rectangle, but is not limited to such a shape and can be circular, oval, square, or diamond-shaped, for instance. As shown in FIGS. 1A and 1C, long sides thereof may curve or bow slightly outward. Alternatively, the long sides may be flat or bowed inwardly. The bottom short side of the moveable panel 120 can be straight, as shown in FIGS. 1A and 1C, or it may also have a slight curve or bow. The top short side of the moveable panel 120 can bow or curve inwardly, as shown in FIGS. 1A and 1C. Alternatively, the top side may be straight or outwardly curved. Optionally, perimeter 121, including optional embodiments where the perimeter defines an elevation transition, may be omitted.

Long sides of the moveable panel 120 can run in a longitudinal or length-wise direction of the container 100, as shown in FIGS. 1A and 1C. Not shown in the container embodiment shown in FIGS. 1A and 1C, depending upon the size and geometry of a container sidewall, more than one moveable panel 120 may be implemented. For instance, a plurality of moveable panels 120 may be provided side-by-side. Optionally or alternatively, moveable panels 120 may be arranged such that one moveable panel is above another moveable panel. Furthermore, alternatively, the moveable panel 120 may be rotated ninety degrees so as to be horizontally oriented. Similarly, multiple panels 120 may be arranged end-to-end horizontally and/or stacked in the vertical direction.

Moveable panel 120 can be comprised of a vertically oriented groove or recess 124. Of course, as noted above, depending upon the overall orientation of the moveable panel 120, in embodiments of the present invention, groove 124 may run horizontally. Optionally, the vertically oriented groove 124 may be centrally aligned in a horizontal and/or vertical direction with the perimeter 121 and/or the corresponding sidewall in general.

Moveable panel 120 also can include three horizontally oriented grooves 126, 127, 128. Each of the horizontally oriented grooves 126, 127, 128 interrupts vertical groove 124 to break this groove into four separate portions 124(1)-(4). Thus, the crosscrossing of groove 124 and grooves 126, 127, 128 creates respective intersections. Each intersection can reduce or eliminate any outward pivot point and thereby prevent unwanted or undesirable distortion or deformation. In embodiments, the maximum travel amount of the movable panel 120 may be based on an amount of travel where unwanted or undesirable distortion or deformation is risked or may occur, such as irreversible roll-out.

Optionally, a maximum depth of grooves 126, 127, 128 may be greater than a maximum depth of groove 124. The maximum depths of grooves 126, 127, 128 may be the same or different. For instance, the maximum depth of groove 127 may be greater than maximum depths of grooves 126, 128. Thus, the horizontal grooves 126, 127, 128 may create a relatively deep cut through the center of the panel, then tapering out to a wide and shallow arc at ends thereof. Moreover, the dimensions of grooves 126, 127, 128 may be the same or different. FIGS. 1A and 1C, for instance, show grooves 126, 127 being slightly smaller than groove 127. Of course the grooves 124, 126, 127, and 128 are not limited to the exact configuration shown in FIGS. 1A and 1C, and may be of other configurations. For instance, rather than a shallow arc at ends thereof, the grooves may have a straight or flat ends. As another example, the grooves may be rectangular or generally rectangular with sharp or rounded corners transitioning from long sides thereof to the short sides and with straight or flat ends defining the short sides.

As shown in FIGS. 1A and 1C, a length-wise direction of groove 124 can be perpendicular to length-wise directions of the grooves 126, 127, 128 and parallel to width-wise directions of these grooves. FIGS. 1A and 1C further show the length-wise direction of groove 124 being parallel to a central longitudinal axis of the container 100, and a length-wise direction of grooves 126, 127, 128 being perpendicular to the central longitudinal axis. However, both groove 124 and the set of grooves 126, 127, 128 can be rotated in codependent fashion such that their respective lengths remain perpendicular to each other, but canted with respect to the central longitudinal axis of the container 100.

Note that groove 127 can bisect groove 124, thereby splitting groove 124 into portions 124(2) and 124(3). In embodiments, only portions 124(2) and 124(3) constitute groove 124 and grooves 126, 128 are omitted along with groove portions 124(1) and 124(4). In yet another embodiment, only portions 124(2) and 124(3) constitute groove 124, but grooves 126, 128 are included. In yet another alternative embodiment, one or more additional grooves 124 may be implemented (or optional portions thereof as indicated above), with corresponding ones of the grooves 126, 127, and 128 interrupting these additional grooves 124 as indicated above. In such cases, the grooves 126, 127, 127 may be made longer and/or wider. The one or more additional grooves 124 also can have a maximum depth less than the maximum depths of each of grooves 126, 127, 128.

Though horizontal and vertical grooves are shown in FIGS. 1A and 1C, embodiments are not limited to grooves or recesses, and may include projections structurally arranged in a same or similar manner that perform the same or similar functions are shown and described herein with respect to the grooves.

Container 100 also can include a base portion 110 arranged adjacent to body portion 108. Base portion 110 can have a lower-most portion thereof defining a standing surface of the container for supporting the container in an upright position. The shape of base portion 110 in bottom end view may be one of generally circular, square, generally square, rectangular, or generally rectangular, for instance. Optionally, the shape of base portion 110 in end view may correspond to the cross sectional shape of the body portion 108.

Base portion 110 also may have a recessed portion 112 and a bottom end thereof, for instance a push-up or vacuum panel portion, arranged axially inward of the standing surface of the base portion 110. Optionally, recessed portion 112 may be stationary once the container 100 is formed and accordingly does not move or does not substantially move in response to pressure variations within the container. Optionally, recessed portion 112 may have a plurality of ribs 113 and/or other suitable support structure, such as braces, to resist movement. Thus, in embodiments, movement of the one or more moveable panels 120 may be the only mechanism to remove and/or reduce an internal vacuum or dynamically compensate for increase pressure within the container 100. Optionally, movement of the one or more moveable panels 120 inwardly may reduce all of the internal vacuum and create a positive pressure within the container 100.

Alternatively, recessed portion 112 may be flexible to accommodate positive and/or negative pressure within the container. To accommodate positive pressure within the container, the recessed portion 112 may flex outwardly, and to accommodate negative pressure within the container 100, the recessed portion may flex inwardly. Thus, recessed portion 112 may remove a portion of an internal vacuum within the container 100 and the one or more moveable panels 120 may remove another portion of the internal vacuum. The two vacuum portions, together, can constitute all of the internal vacuum. Optionally, recessed portion 112 and the one or more moveable panels 120 may remove all of the internal vacuum and create a positive pressure. Movement of the recessed portion 112 inwardly to compensate for an internal vacuum can be solely in response to the vacuum forces (i.e., the vacuum forces can cause movement), or movement can be assisted by a mechanical or pneumatic device acting on the recessed portion 112 from outside the container. Such movement of the recessed portion 112 can be such that the recessed portion is always at or above the standing surface of the bottom portion 110 at all times.

FIGS. 1A and 1C show an embodiment of a container 100 without any hoop rings, bumpers, or annular support structure at the juncture of the body portion 108 and base portion 110.

However, one or more embodiments of the present invention may include a hoop ring, a bumper, or an annular structure at this juncture.

As indicated earlier, each moveable portion 120 can be configured and operative to move outward to accommodate increased pressure within the container 100 and to move inwardly to accommodate decrease pressure within the container 100. For instance, regarding increased pressure, the moveable portion can move outwardly to break a surface plane of the container sidewall in response to a predetermined internal pressure without unwanted or impermissible deformation or distortion.

Figure 2A:
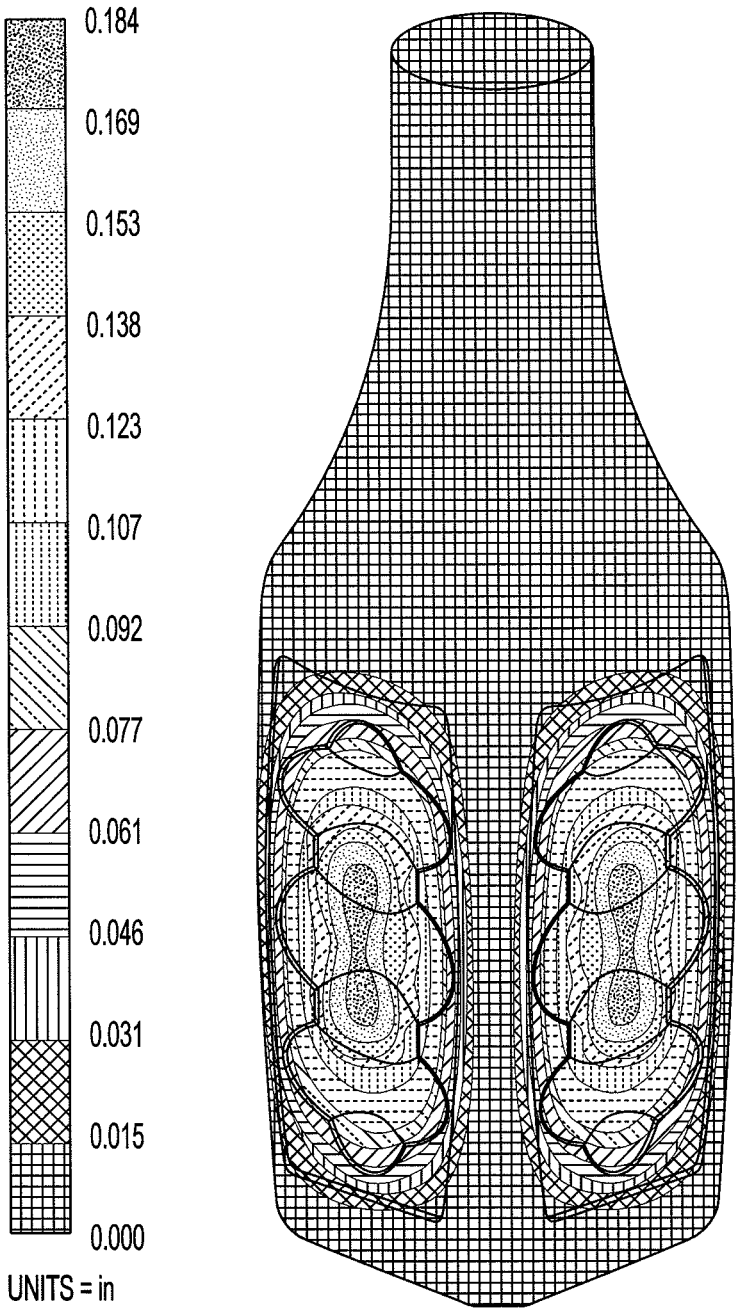
FIG. 2A shows an example of how various portions of a container according to embodiments of the present invention react to an internal pressure within the container.
Figure 2B:
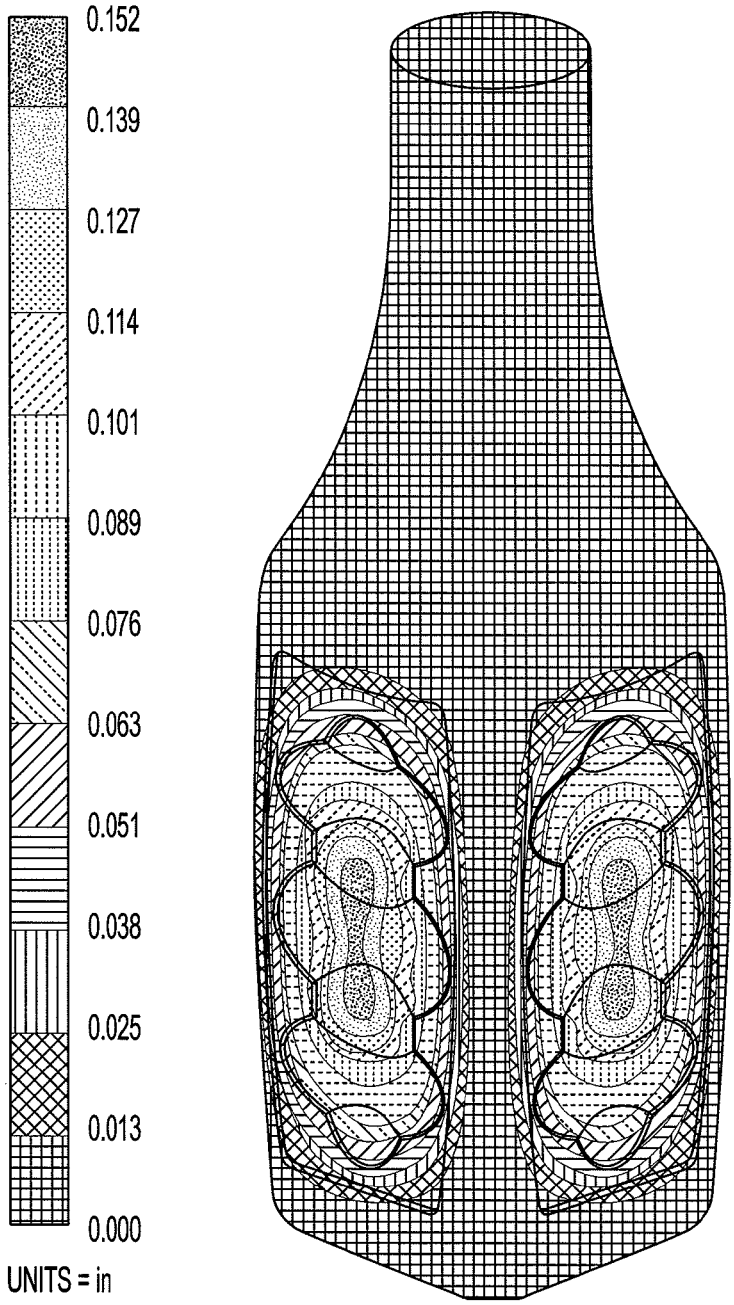
FIG. 2B shows another example of how various portions of another container according to embodiments of the present invention react to an internal pressure within the container.

FIGS. 2A and 2B show examples of two different containers and amounts of movement in response to positive pressure within the container. The results shown in FIG. 2A differ from the results shown in FIG. 2B in that the containers are of different weight. Results may differ for different embodiments due to a variety of factors, including the weight of the container, the size of the container, the geometry of the container and/or one or more moveable portions/panels 120, the fill temperature, the fill product, etc. The different indicia show an amount of movement in inches for the various portions of the container, and in particular the different portions of the moveable portions/panels 120. As indicated in FIGS. 2A and 2B, panels 120 can move, for example, move outwardly to create a bulge such that respective portions of the panels 120 break surface planes of the corresponding sidewalls, but do not permanently or irreversibly deform.

Figure 3:
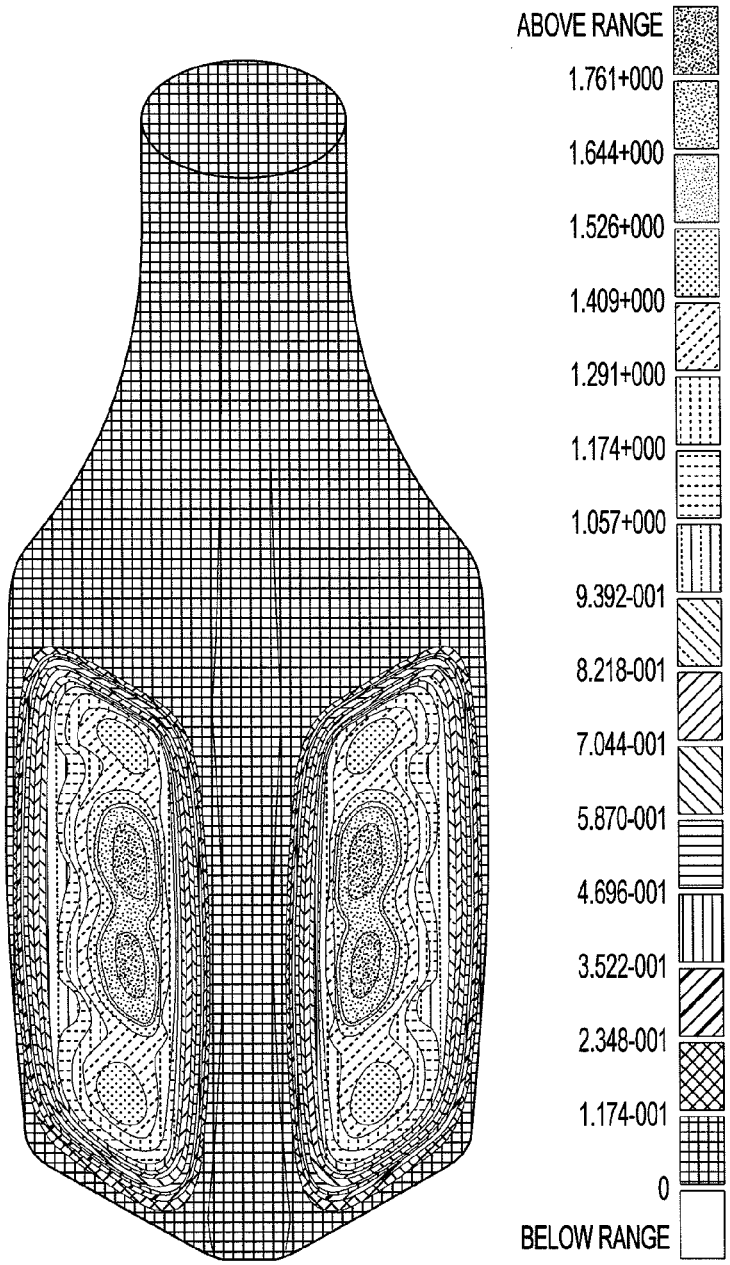
FIG. 3 shows an example of how various portions of a container according to embodiments of the present invention react to an internal vacuum within the container.

FIG. 3 on the other hand shows an example of how panels 120 move in response to a negative pressure within the container. FIG. 3 defines inward movement in terms of millimeters. Movement inward of panels 120 can be such that full extraction of the panel can be reached before failure of the panel 120. Thus, panels 120 can remove some or all of the internal vacuum within the container.

Figure 4A:
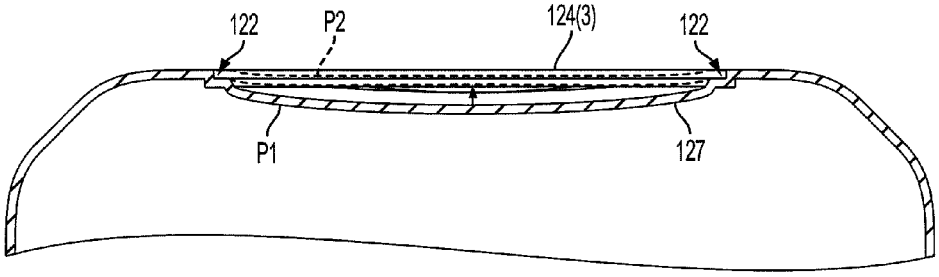
FIG. 4A shows outward movement of a moveable portion of a container according to embodiments of the present invention.
Figure 4B:
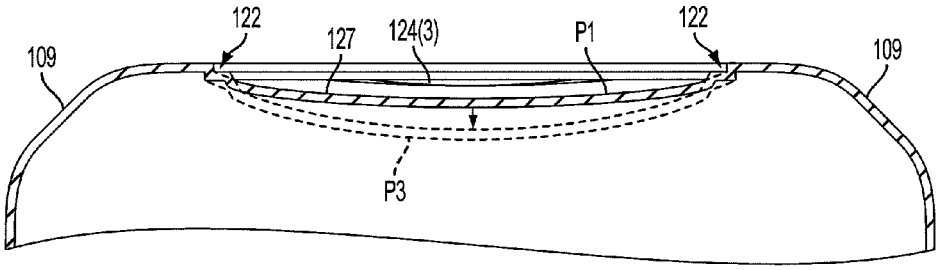
FIG. 4B shows inward movement of the moveable portion shown in FIG. 4B.

FIGS. 4A and 4B are taken along cross-section A-A' of the container 100 from FIG. 1A and show outward and inward flexing of moveable portion/panel 120, respectively, according to embodiments of the present invention. FIGS. 4A and 4B may be interpreted as diagrammatic and for illustrative purposes only and may not represent exact movement of the moveable portion/panel 120.

As shown in FIG. 4A, panel 120 may be formed in an as-formed or blow molded position P1. In response to internal positive pressure within the container, the panel 120 may move outwardly to a second position P2 (shown by dashed lines). FIG. 4A specifically shows groove 127 moving to position P2, but other portions of the panel 120 may also move, such as portions of the groove 124 and grooves 126, 128 (not expressly shown). As indicated earlier, movement to second position P2 can be temporary and to an extent that does not cause or create roll-out, inversion, or an otherwise permanent or irreversible deformation of panel 120. Furthermore, each moveable panel 120 may move to a same or different position P2 in response to the internal positive pressure of the container.

FIG. 4B shows panel 120 flexing inwardly to a third position P3. FIG. 4B shows the panel 120 moving from position P1, but panel 120 may move through position P1 from position P2 in response to internal negative pressures within the container. Further, though P3 is shown as being inward of P1, generally, P3 may not necessary extend inward of P1. Furthermore, each moveable panel 120 may move to a same or different position P3 in response to the internal negative pressure within the container. Such movement of panel 120 may remove some or all of the internal vacuum. Collectively, all of the panels 120 may remove some or all of the internal vacuum.

Figure 5:
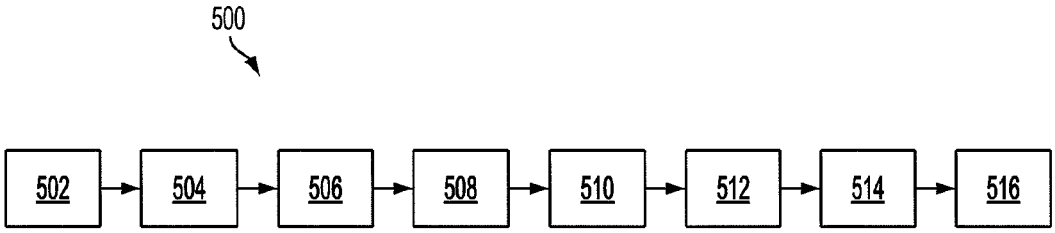
FIG. 5 is a block diagram of a system according to an embodiment or embodiments of the present invention.

FIG. 5 is a block diagram of a system 500 according to embodiments of the present invention.

Block 502 can represent a forming station for forming a container according to embodiments of the present invention. Forming the container can entail blow molding (e.g., including injection blow molding, stretch blow molding, extrusion blow molding, etc.) a threaded or non-threaded parison in a mold of a blow molding apparatus.

Plastic containers according to embodiments of the present invention can be formed of plastic materials known in the art. The containers may have, for example, a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the containers can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties.

After forming the container at 502, the container (or containers) can be provided for further operations or processing 504. Providing the container can include simply possessing or receiving the container in its as-formed or a modified form thereof. The container may be provided alone or with a plurality of other containers, for example, on a pallet. Providing also can include transport of the container within a facility or to another separate facility. In embodiments, the container can be provided to a filling station, such as a rotatory filling machine. The container may be provided to the filling station via a conveyor belt, for instance, with the container resting on its standing surface directly on the conveyor or on a container holding apparatus.

Item 506 in FIG. 5 can represent a filling station or apparatus of the system 500. Filling station 506 can fill the container with a product as set forth herein. As indicated earlier, the product may be filled at an elevated temperature, which may constitute a hot-fill. In the case of hot-filling, such filling can push out portions of the container due to weight of product and heat of the product transferring to the container material, which can relax the plastic material.

After filling the container at filling station 506, the container may be capped at a capping station. In embodiments, the capping station 508 may be relatively close to or part of the filling station such that the containers may be capped approximately thirty seconds after being filled, for instance. Moveable portions as shown and described herein may compensate for internal positive pressures within the container caused by the hot-filling and/or capping. Optionally, a moveable bottom end portion may move to assist with accommodation of the internal positive pressures.

In the case of hot-filling the container with a product, the container may be passed to a cooling station or apparatus 510.

Cooling can comprise, for instance, an initial air cool for a predetermined time period (e.g., 2.5 minutes), and then further cooling operations, such as a cold water bath (e.g., at room temperature), until the product is at a predetermined temperature, such as room temperature. Cooling can create an internal vacuum within the container, and the internal vacuum can cause the one or more moveable portions to move inwardly as set forth herein. Such movement inward of the one or more moveable portions can remove or reduce the vacuum within the container.

Optionally, a bottom end portion of the container may be caused to move inward as a result of the vacuum or by mechanical or pneumatic means 512. Further processing stations or apparatuses may also be part of system 500, such as an inspection station or apparatus 514 and a label placement station or apparatus 516 that can apply or label, such as a shrink wrap (i.e., sleeve) label or a wrap-around label. The container can then be subjected to further processing, including transporting of the container to a remote location for storage and/or consumption.

Figure 6:
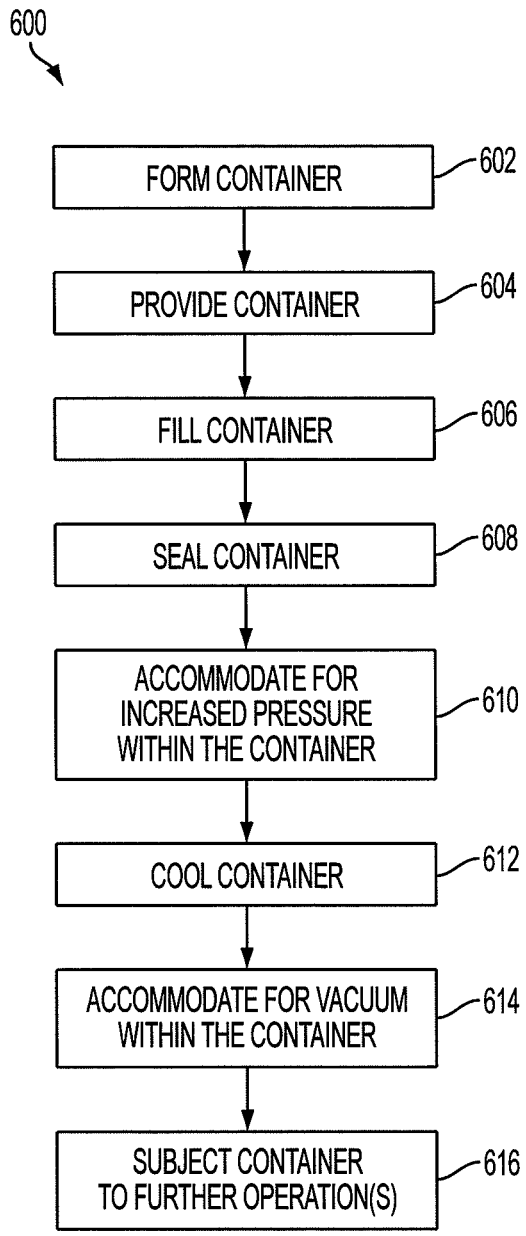
FIG. 6 is a flow chart for a method according to an embodiment or embodiments of the present invention.

FIG. 6 is a flow chart for a method 600 according to embodiments of the disclosed subject matter.

Method can proceed to step 602, whereby a plastic container according to embodiments of the present invention as shown and described herein can be formed, for instance, by blow molding. After step 602, the container can be provided for further processing and operations as shown and described herein. For instance, providing the container can include simply possessing or receiving the container in its as-formed or a modified form thereof. The container may be provided alone or with a plurality of other containers, for example, on a pallet. Providing also can include transport of the container within a facility or to another separate facility. In embodiments, the providing can include providing the container for filling, for instance, to a filling station or apparatus.

At 606, the container can be filled with a product as set forth herein. In embodiments, the container can be filled with a hot-product, and then sealed with a closure 608. One or more moveable portions of a container as set forth herein may move outward in response to an internal force within the container due to the filling and/or sealing. The container can then be cooled 612, and such cooling can create a vacuum in the container. The vacuum can be accommodated by inward movement of the one or more moveable portions of the container 614, and such inward movement can reduce some or all of the internal vacuum. Supplemental vacuum reduction can be performed by movement inward of a bottom end portion of the container. Further steps can be taken 616, including inspection of the filled container, labeling of the container, transport of the container, etc.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicant intends to embrace all such alternatives, modifications, equivalents, and variations that are within the spirit and scope of the present invention.

What is claimed is:

1. A hot-fillable plastic bottle of generally square shape in bottom end view, but with chamfered corners, the plastic bottle being without any hoop rings and comprising:

a threaded upper portion defining an opening into the bottle and having a lip at an end thereof opposite the opening, said threaded upper portion being configured to be threadedly mated with a cap;

an elongate neck portion arranged adjacent to said threaded upper portion, said elongate neck portion tapering radially outward in a direction away from said threaded upper portion; a body portion having four sidewalls and being arranged adjacent to a widest part of said elongate neck portion, each said sidewall having an outer surface and a recessed moveable panel with a generally rectangular perimeter in a side view of the bottle, each recessed moveable panel being recessed relative to the outer surface of the sidewall with long sides of the recessed moveable panel running vertically in a longitudinal direction of the bottle, and the recessed moveable panel including:

a vertically oriented groove centrally aligned within the perimeter of the recessed moveable panel and having a maximum depth thereof at a first depth relative to an outer surface of the recessed moveable panel; and three horizontally oriented grooves each having a maximum depth thereof relative to the outer surface of the recessed moveable panel at a second depth greater than the first depth, each of said three horizontally oriented grooves interrupting said vertically oriented groove, and said vertically extending groove having a portion arranged above a top one of said horizontally oriented grooves in the longitudinal direction of the bottle and a portion arranged below a bottom one of said horizontally oriented grooves in the longitudinal direction of the bottle;

and a base portion arranged adjacent to said body portion and having a lower-most portion thereof defining a standing surface of the bottle, wherein each of said recessed moveable panels is configured (i) to flex outward temporarily without permanently deforming, rolling-out, or inverting in response to an internal pressure within the bottle, and (ii) to flex inward in response to an internal vacuum.

2. The plastic bottle according to claim 1, wherein each of said recessed moveable panels is configured to flex outward temporarily to break a surface plane of a corresponding one of said four sidewalls without permanently deforming, rolling-out, or inverting in response to the internal pressure.

3. The plastic bottle according to claim 1, wherein the flexing inward of each said recessed moveable panel is to a respective position inward of an as-formed position of said recessed moveable panel.

4. The plastic bottle according to claim 1, wherein the flexing inward of said recessed moveable panels is by a same amount or substantially a same amount for each said recessed moveable panel.

5. The plastic bottle according to claim 1, wherein the flexing outward of said recessed moveable panels is by a same amount or substantially a same amount for each said recessed moveable panel.

6. The plastic bottle according to claim 1, wherein the flexing inward of the recessed moveable panels compensates for an entirety of the internal vacuum.

7. The plastic bottle according to claim 6, wherein the flexing inward of the recessed moveable panels compensates for an entirety of the internal vacuum and creates a positive pressure within the bottle.

8. The plastic bottle according to claim 1, further comprising a push-up bottom end portion arranged axially inward of the standing surface of said base portion.

9. The plastic bottle according to claim 8, wherein the flexing inward of the recessed moveable panels compensates for a portion of the internal vacuum, and the push-up bottom end portion is configured to move toward the interior of the bottle to remove a remaining portion of the internal vacuum, and wherein movement toward the interior of the bottle of the push-up bottom end portion creates a positive pressure within the bottle.

10. The plastic bottle according to claim 8, wherein the push-up bottom end portion is configured and operative to always be at or above the standing surface of the bottom portion of the bottle.

11. A plastic container comprising:

an upper portion defining an opening into an internal volume of the container;

a body portion having a sidewall with an outer surface and a predefined moveable portion recessed relative to the outer surface of the sidewall, said predefined moveable portion including within a perimeter thereof a first recess oriented vertically in a first direction and a second recess oriented in a second direction perpendicular to the first direction, the first recess having a first maximum depth relative to an outer surface of the moveable portion, and the second recess having a second maximum depth relative to the outer surface of the moveable portion, the second maximum depth being greater than the first maximum depth, the second recess physically bisecting the first recess so as to divide the first recess into a first recess portion of the first recess and a second recess portion of the first recess; and a base portion for supporting the plastic container in an upright position.

12. The plastic container according to claim 11, wherein said predefined moveable plastic portion further comprises a third recess oriented in the second direction and a fourth recess oriented in the second direction, the third recess physically crossing the first recess portion of the first recess, and the fourth recess physically crossing the second recess portion of the first recess;

wherein the third and fourth recesses each has a maximum depth relative to the outer surface of the moveable portion greater than the first maximum depth of the first recess portion.

13. The plastic container according to claim 12, wherein the third recess oriented in the second direction physically crosses the first recess so as to split the first recess into the first recess portion and a third recess portion, the third recess portion being at one extremity of the first recess, wherein the fourth recess oriented in the second direction physically crosses the first recess so as to split the first recess into the second recess portion and a fourth recess portion, the fourth recess portion being at another extremity of the first recess opposite to the one extremity of the first recess, wherein the third and fourth recesses have the same dimensions, wherein the second recess has a maximum width greater than a maximum width of the third and fourth recesses, wherein the first and second recess portions have the same dimensions, and wherein the third and fourth recess portions have the same dimensions.

14. The plastic container according to claim 11, wherein the container has a plurality of predefined moveable portions of similar configuration as said predefined moveable portion.

15. The plastic container according to claim 11, wherein the sidewall defines a surface plane, the predefined moveable portion being entirely recessed with respect to the surface plane of the sidewall and surrounded by a continuous downward transition from the sidewall.

16. The plastic container according to claim 11, wherein the predefined moveable portion is configured and operative to move from a first, as-formed position outwardly to a second position, and to move inwardly to a third position after movement thereof to the second position.

* * * * *